US008439254B2

(12) United States Patent
Smalley

(10) Patent No.: US 8,439,254 B2
(45) **Date of Patent: *May 14, 2013**

(54) FULLY ENCLOSED CARTON

(75) Inventor: Brian Leslie Smalley, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/553,063

(22) Filed: Jul. 19, 2012

(65) Prior Publication Data

US 2012/0280025 A1 Nov. 8, 2012

Related U.S. Application Data

(60) Continuation of application No. 12/913,024, filed on Oct. 27, 2010, now Pat. No. 8,231,513, which is a division of application No. 11/250,034, filed on Oct. 13, 2005, now Pat. No. 7,832,621.

(30) Foreign Application Priority Data

Oct. 19, 2004 (GB) ..... 0423162.7

(51) Int. Cl.
*B65D 5/46* (2006.01)
*B65D 17/00* (2006.01)

(52) U.S. Cl.
USPC ..... 229/117.16; 229/242

(58) Field of Classification Search ..... 229/240, 229/109
See application file for complete search history.

(56) References Cited

U.S. PATENT DOCUMENTS

| | | | |
|---|---|---|---|
| 2,196,502 | A | 4/1940 | Kells |
| 2,308,050 | A | 1/1943 | Brown et al. |
| 2,594,376 | A | 4/1952 | Arneson |
| 2,810,506 | A | 10/1957 | Kessler |
| 2,844,299 | A | 7/1958 | Kessler et al. |
| 2,868,433 | A | 1/1959 | Anderson, Jr. |
| 2,955,739 | A | 10/1960 | Collura |
| 3,112,856 | A | 12/1963 | MacIntosh et al. |
| 3,204,814 | A | 9/1965 | Mahon |
| 3,355,089 | A | 11/1967 | Champlin |
| 3,825,170 | A | 7/1974 | Aust et al. |
| 3,974,658 | A | 8/1976 | Starrett |
| 4,036,423 | A | 7/1977 | Gordon |
| 4,084,693 | A | 4/1978 | Culpepper |
| 4,096,985 | A | 6/1978 | Wood |
| 4,216,861 | A | 8/1980 | Oliff |
| 4,328,923 | A | 5/1982 | Graser |
| 4,378,905 | A | 4/1983 | Roccaforte |
| 4,498,619 | A | 2/1985 | Roccaforte |

(Continued)

FOREIGN PATENT DOCUMENTS

| | | |
|---|---|---|
| AT | 357 933 | 8/1980 |
| CA | 2 160 145 | 9/1995 |

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A fully enclosed paperboard carton having a top, a base, a pair of oppositely disposed sides and a pair of oppositely disposed end panels. Each end panel being substantially planar and perpendicular to the base and top. Each side having a lower portion that is substantially planar and perpendicular to the base and an upper portion that is substantially planar and tapers inwardly towards its edge connection with the top.

23 Claims, 9 Drawing Sheets

U.S. PATENT DOCUMENTS

| | | | |
|---|---|---|---|
| 4,546,914 | A | 10/1985 | Roccaforte |
| 4,577,799 | A | 3/1986 | Oliff |
| 4,621,766 | A | 11/1986 | McClure |
| 4,944,451 | A | 7/1990 | Forbes, Jr. |
| 4,951,868 | A | 8/1990 | Mode |
| 4,967,901 | A | 11/1990 | Wood |
| 5,020,337 | A | 6/1991 | Krieg |
| 5,072,876 | A | 12/1991 | Wilson |
| 5,246,112 | A | 9/1993 | Stout et al. |
| 5,292,058 | A | 3/1994 | Zoss et al. |
| 5,303,863 | A | 4/1994 | Arasim |
| 5,350,109 | A | 9/1994 | Brown et al. |
| 5,427,241 | A | 6/1995 | Sutherland |
| 5,427,306 | A | 6/1995 | Petriekis et al. |
| 5,482,203 | A | 1/1996 | Stout |
| 5,487,505 | A | 1/1996 | Nilsson |
| 5,495,727 | A | 3/1996 | Strong et al. |
| 5,582,343 | A | 12/1996 | Dalvey |
| 5,639,017 | A | 6/1997 | Fogle |
| 5,704,470 | A | 1/1998 | Sutherland |
| 5,794,778 | A | 8/1998 | Harris |
| 5,873,515 | A | 2/1999 | Dunn et al. |
| 5,915,546 | A | 6/1999 | Harrelson |
| 5,992,733 | A | 11/1999 | Gomes |
| 6,065,590 | A | 5/2000 | Spivey |
| 6,085,969 | A | 7/2000 | Burgoyne |
| 6,112,977 | A | 9/2000 | Sutherland et al. |
| 6,164,526 | A | 12/2000 | Dalvey |
| 6,227,367 | B1 | 5/2001 | Harrelson et al. |
| 6,250,542 | B1 | 6/2001 | Negelen |
| 6,302,320 | B1 | 10/2001 | Stout |
| D452,154 | S | 12/2001 | Rhodes et al. |
| 6,371,365 | B1 | 4/2002 | Doucette et al. |
| 6,631,803 | B2 | 10/2003 | Rhodes et al. |
| 6,926,193 | B2 | 8/2005 | Smalley |
| 6,945,450 | B2 | 9/2005 | Rusnock |
| 6,968,992 | B2 | 11/2005 | Schuster |
| 7,234,596 | B2 | 6/2007 | Lebras |
| 7,296,731 | B2 | 11/2007 | Auclair et al. |
| 7,699,215 | B2 | 4/2010 | Spivey, Sr. |
| 7,757,933 | B2 | 7/2010 | Dunn |
| 7,832,621 | B2 | 11/2010 | Smalley |
| 2006/0081691 | A1 | 4/2006 | Smalley |
| 2006/0273143 | A1 | 12/2006 | Finch |
| 2007/0051781 | A1 | 3/2007 | Holley, Jr. |
| 2007/0063003 | A1 | 3/2007 | Spivey et al. |
| 2010/0025457 | A1 | 2/2010 | Cooper et al. |
| 2011/0290692 | A1 | 12/2011 | Spivey, Sr. |

FOREIGN PATENT DOCUMENTS

| | | |
|---|---|---|
| DE | 26 55 591 | 6/1978 |
| DE | 202 06 426 U1 | 10/2002 |
| GB | 1 395 644 | 5/1975 |
| JP | 51-72576 | 6/1976 |
| JP | 54-97185 | 8/1979 |
| JP | S59-159511 | 10/1984 |
| JP | 5-9303 | 3/1993 |
| JP | 7-35315 | 6/1995 |
| WO | WO 91/04916 | 4/1991 |
| WO | WO 94/03374 | 2/1994 |
| WO | WO 2007/089282 | 8/2007 |

FULLY ENCLOSED CARTON

CROSS-REFERENCE TO RELATED APPLICATIONS

This application is a continuation application of U.S. patent application Ser. No. 12/913,024, filed Oct. 27, 2010, which is a divisional application of U.S. patent application Ser. No. 11/250,034, filed Oct. 13, 2005, now U.S. Pat. No. 7,832,621, issued on Nov. 16, 2010, which application claims convention priority from British Patent Application No. 0423162.7, filed Oct. 19, 2004.

INCORPORATION BY REFERENCE

U.S. patent application Ser. No. 12/913,024, filed Oct. 27, 2010, U.S. patent application Ser. No. 11/250,034, filed Oct. 13, 2005, and British Patent Application No. 0423162.7, filed Oct. 19, 2004, are hereby incorporated by reference for all purposes as if presented herein in their entirety.

TECHNICAL FIELD

The present invention relates to fully enclosed cartons made from paperboard for enclosing articles.

BACKGROUND

Conventional cartons carry bottles, in perhaps a 6×4 array, or in other arrangements in straight-sided rectangular cartons made out of corrugated board or other materials.

SUMMARY

According to the present invention there is provided a fully enclosed paperboard carton having a top, a base, a pair of oppositely disposed sides and a pair of oppositely disposed end panel arrangements, each end panel arrangement being substantially planar and perpendicular to the base and top and each side having a lower portion which is substantially planar and perpendicular to the base and an upper portion which is substantially planar and tapers inwardly towards its edge connection with the top.

Each end panel arrangement can comprise top, base and side end panels each hingedly connected to the respective top, base and sides, all being adhesively secured.

In some arrangements, each base end panel can be foldably connected at each side to a gusset panel which in turn is hingedly connected to its adjacent side end panel. Conveniently the fold connection of the gusset panel with the base end panel can be perpendicular to the fold between the base and the base end panel and the fold connection of the gusset panel with the side end panel is 45° relative to the fold connection to the base end panel.

Each top end panel can be a primary push through flap to define a handle hole. In some embodiments, at each end of the carton, each of the two side end flaps are positioned behind the top end panel and have a secondary push through flap behind the primary push through flap, all push through flaps being rotatable inwardly through 180° when moved into a carrying position by a user. The primary push through flap at each end can remain hingedly connected to the top end panel along a substantially straight primary fold line and also the secondary can be pushed through flaps at each end remain hingedly connected to the side end panels along substantially straight secondary fold lines adjacent the primary fold line. In some embodiments the primary fold line comprises a pair of folds, spaced vertically by a small distance to define a support panel therebetween.

With some arrangements at each end of each side, a corner formation each defines a pair of creases, one crease extending from the apex between the top, side and end panel arrangement to a horizontal crease joining the upper and lower side portions and the other crease extending from the apex between the base, side and end panel arrangement to the join between the upper and lower side portions.

Normally lines of weakening can be provided such as in the top and/or sides, to facilitate access to the carton contents.

Embodiments of the present invention will now be described in more detail.

BRIEF DESCRIPTION OF THE DRAWINGS

The description makes reference to the accompanying drawings in which.

DETAILED DESCRIPTION

Figure 1:
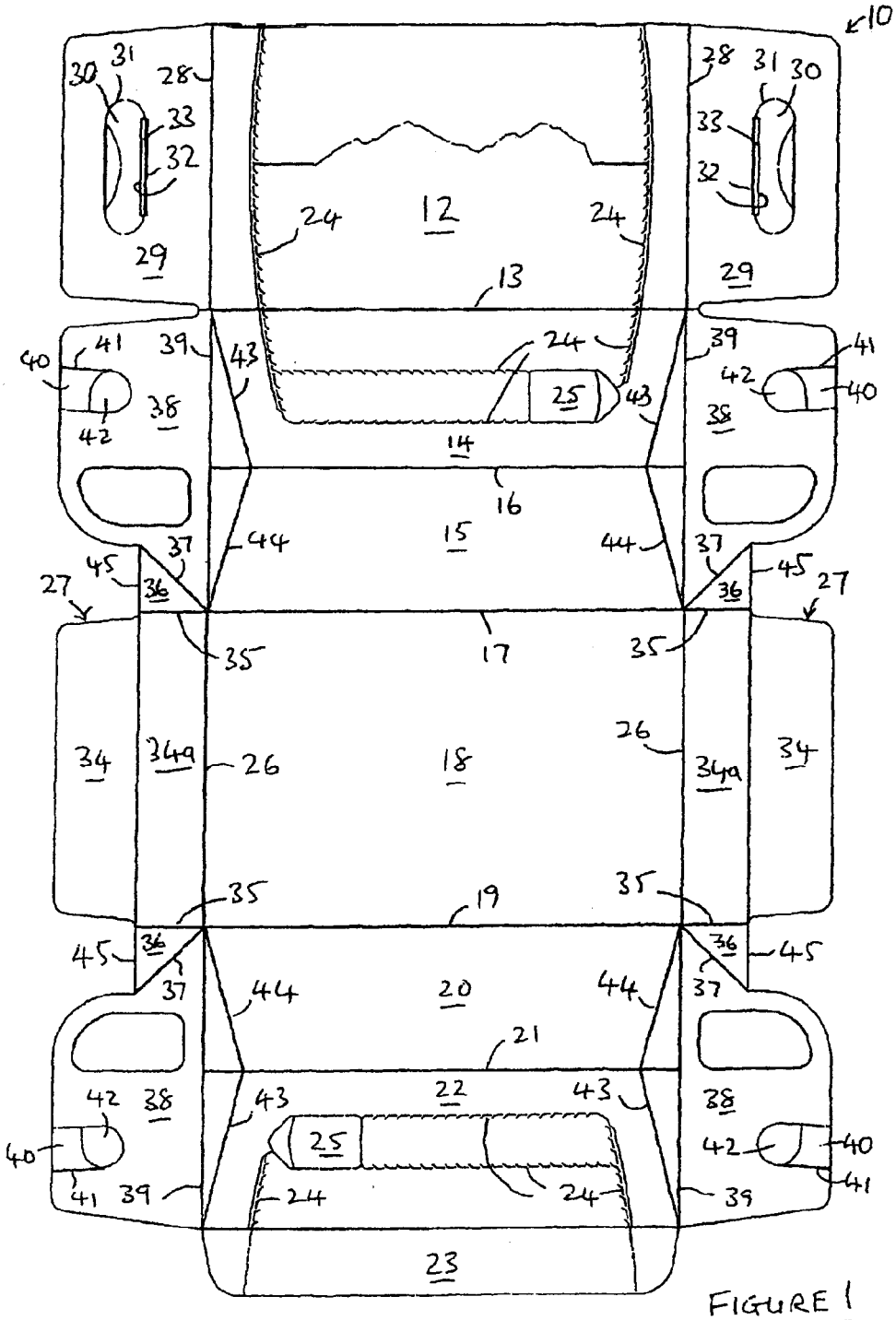
FIG. 1 shows a paperboard blank for producing a carton according to the present invention.
Figure 2:
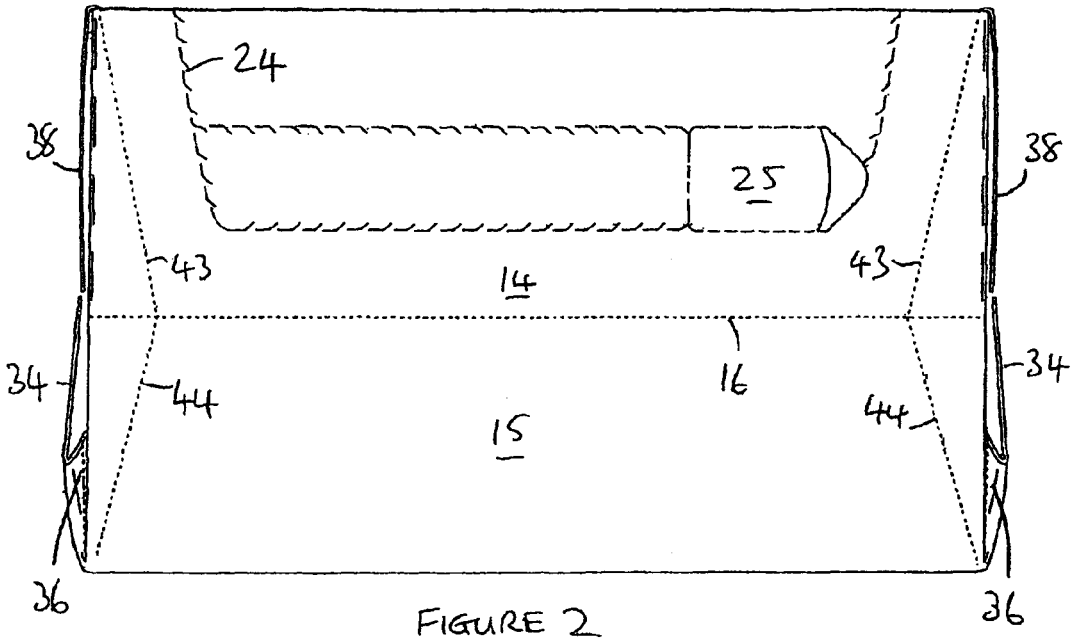
FIG. 2 is a side view of a carton formed from the blank of FIG. 1.
Figure 3:
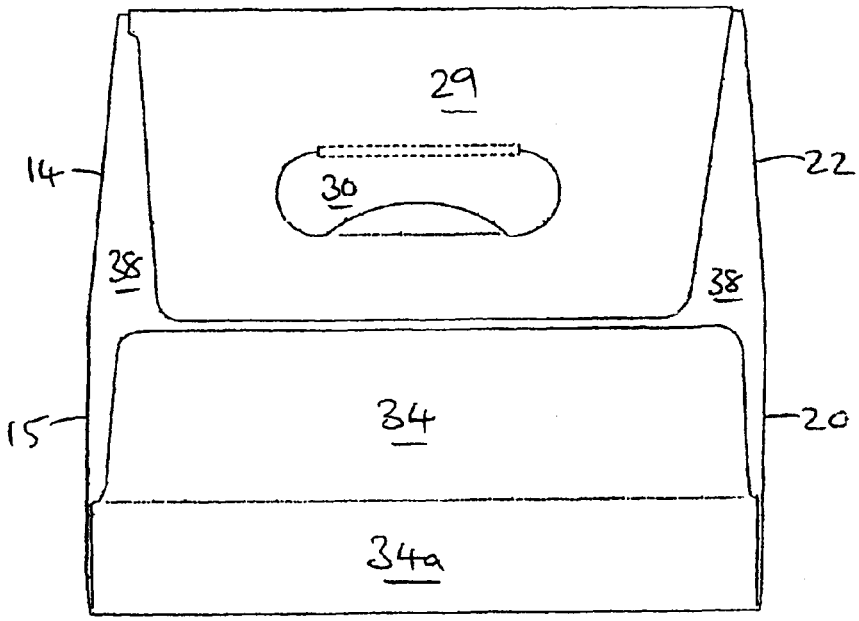
FIG. 3 is an end view of the carton shown in FIG. 2.
Figure 4:
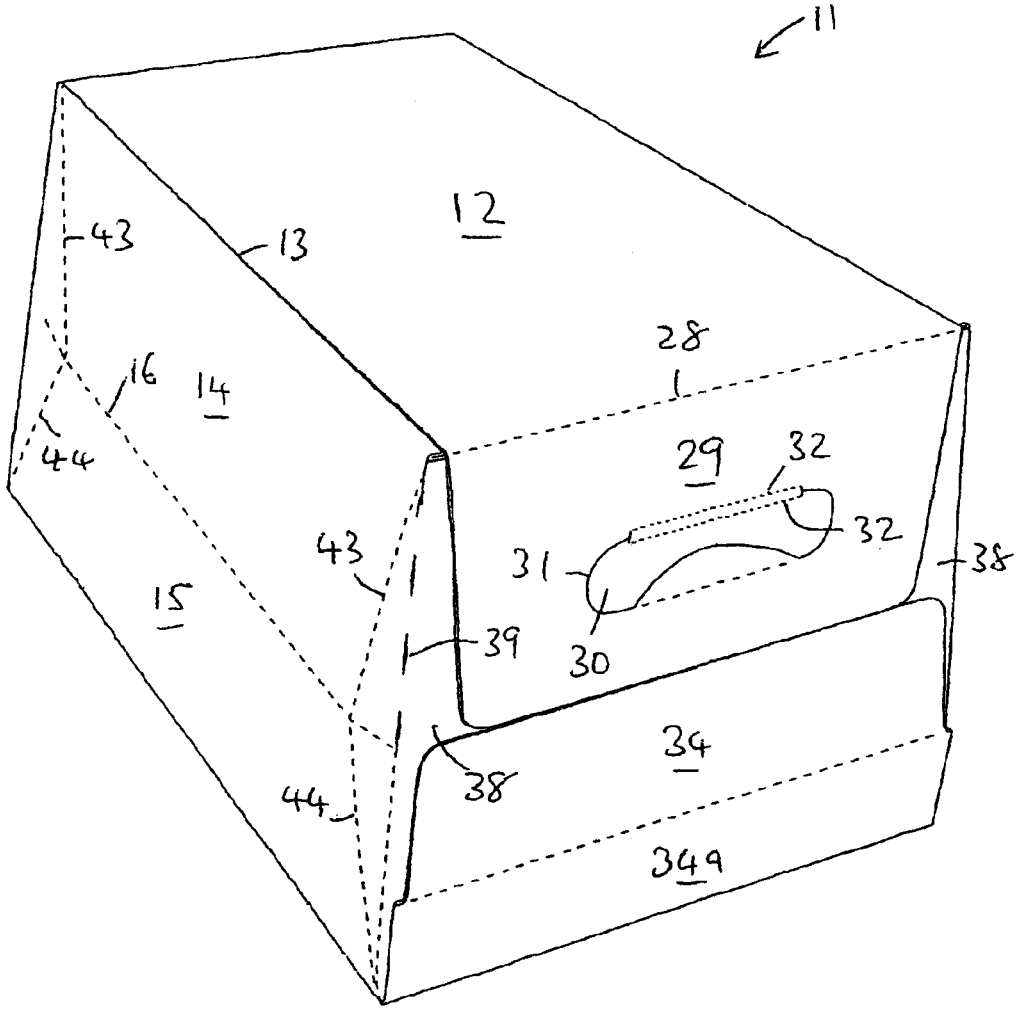
FIG. 4 is an end perspective view of the carton shown in FIG. 2.

In FIG. 1 there is shown a paperboard blank 10 for producing a paperboard carton 11 of the fully enclosed type, as shown in the other figures. The carton 10 could contain a number of bottles, perhaps 24 in a 6×4 array, such as 3×4, 4×3, 4×6, 5×6, 6×5, 3×2, 2×3, 2×6, 6×2, etc., although other sizes and configurations are of course possible. Although shown and described with bottles, the carton 10 could enclose cans or other containers.

The blank 10 provides a top 12 which is hingedly connected along a fold 13 to a first upper side portion 14 which in turn is connected to a first lower side portion 15 along a crease 16. The lower side portion 14 is hingedly connected along a base fold 17 to a base 18 which is hingedly connected along a second base fold 19 to a second lower side portion 20. The second lower side portion 20 is connected along a crease 21 to a second upper side portion 22 which in turn is hingedly connected to gluing panel 23.

When the pack is being assembled, the base, top and sides can form a sleeve with the gluing panel 23 adhesively secured to the inside of the top 12. Lines of weakness 24 in the form of perforations or paperboard zips are optionally provided in the top and sides to facilitate access to the contents of the carton 10 after assembly is completed. The precise shape, form and location of the lines of weakness 24 are a matter of design choice. In the embodiment shown there is a small removable portion 25 on which would be printed the bar code or other identifying means for the product, such that, for example, the removable portion 25 could be torn off and handed to the cashier at the point of sale to avoid unnecessary lifting of a potentially heavy carton.

Hingedly connected at each end of the base 18 along a fold 26 is a base end panel 27 and hingedly connected at each end of the top 12 along a fold 28 is a top end panel 29. Each top end panel 29 has a push through flap 30 defined by a cut or an intermittent cut line 31 in the illustrated embodiment. The push through flap 30, however, remains attached at its upper edge to the top end panel 29 by means of a pair of spaced folds 32 which define therebetween a narrow support panel 33, the purpose of which will be discussed later.

Each base end panel 27 has an upper end portion 34 remote from the fold 26 and a lower end portion 34*a* which is hingedly attached at both sides by means of folds 35 to respective gusset panels 36. The gusset panels 36 are hingedly connected by means of reverse approximately 45° folds 37 to respective side end panels 38 which in turn are hingedly connected by means of folds 39 to the upper and lower side portions 14, 15. The part of the fold 39 connecting the upper side portions 14, 22 to the side end panel 38 is shown in this embodiment as a scored fold line.

Each side end panel 38 also has a partial secondary push through flap 40 which is hingedly connected to the side end panel along a fold 41. Adjacent the secondary push through flap is a hole 42, the hole 42 and the secondary push through flap 40 being positioned so as to be aligned with the push through flap 30 of the top end panel 29 when the carton 11 is assembled.

In each upper side portion 14, at each end of the carton, a crease 43 extends from the top end corner to the crease 16 a short distance in from the end. Similarly in each lower side portion 15, there is a crease 44 extending from the base end corner to the crease 16 at the point where the crease 43 meets the crease 16.

The carton 11 can be assembled in a number of ways. In one method, the top, base and sides are folded to form a sleeve by adhesively securing the gluing panel 23 to the inside of the top 12. This can be done on machine or partially folded/glued blanks 10 can be supplied folded flat and opened up on the machine. The bottles (or other articles) are then inserted through an open end before the end panels are folded and glued. In another method the blanks 10 are folded around the bottles (or other articles) before securing the gluing panel 23 and then folding/gluing the end panels. This latter method makes the blank 10 suitable for running on a conventional machine for producing plain rectangular corrugated board cartons, thus giving the existing machines more flexibility in the types of carton they can produce.

Figure 9:
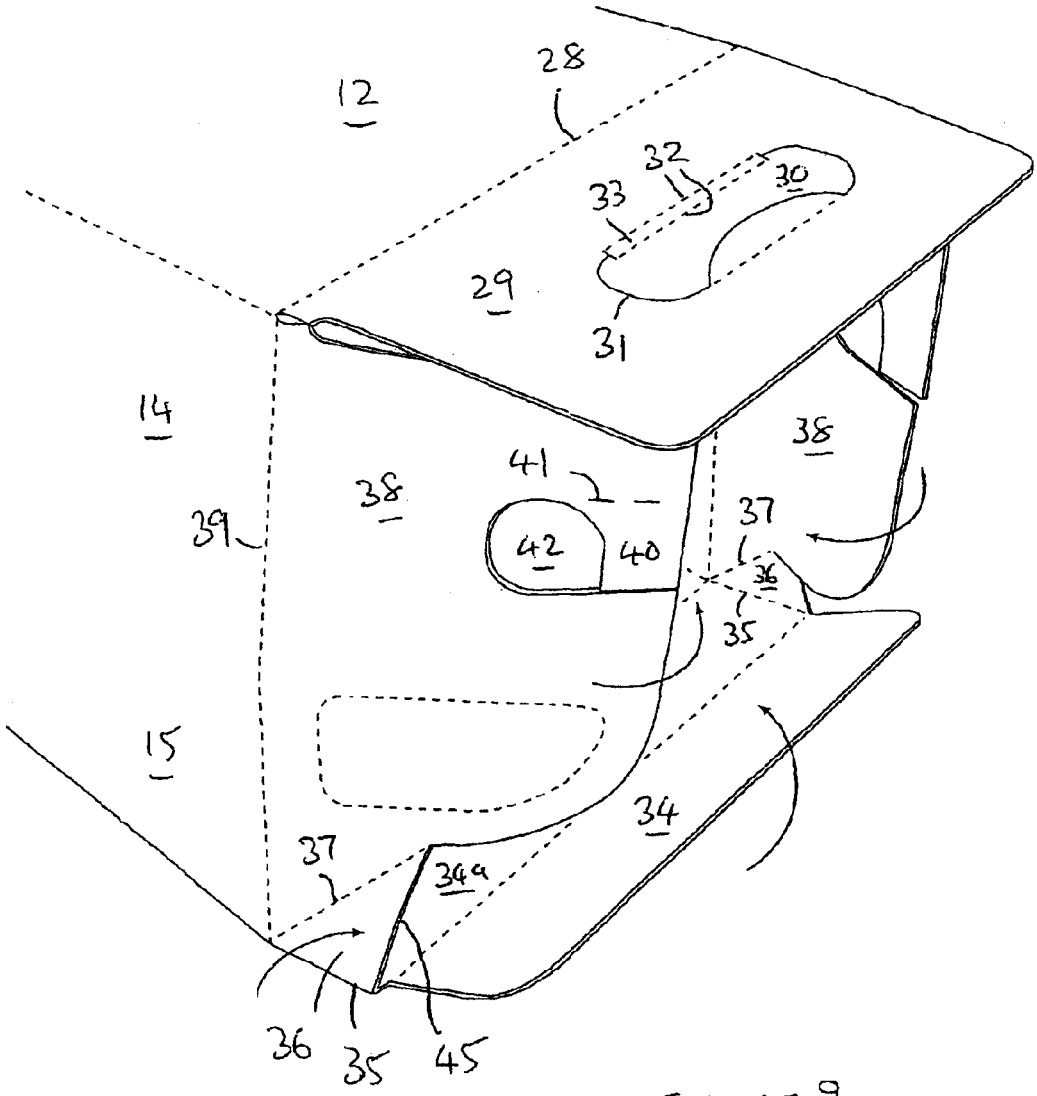
FIG. 9 is an end perspective view of the end panels of the FIG. 2 carton being folded.
Figure 10:
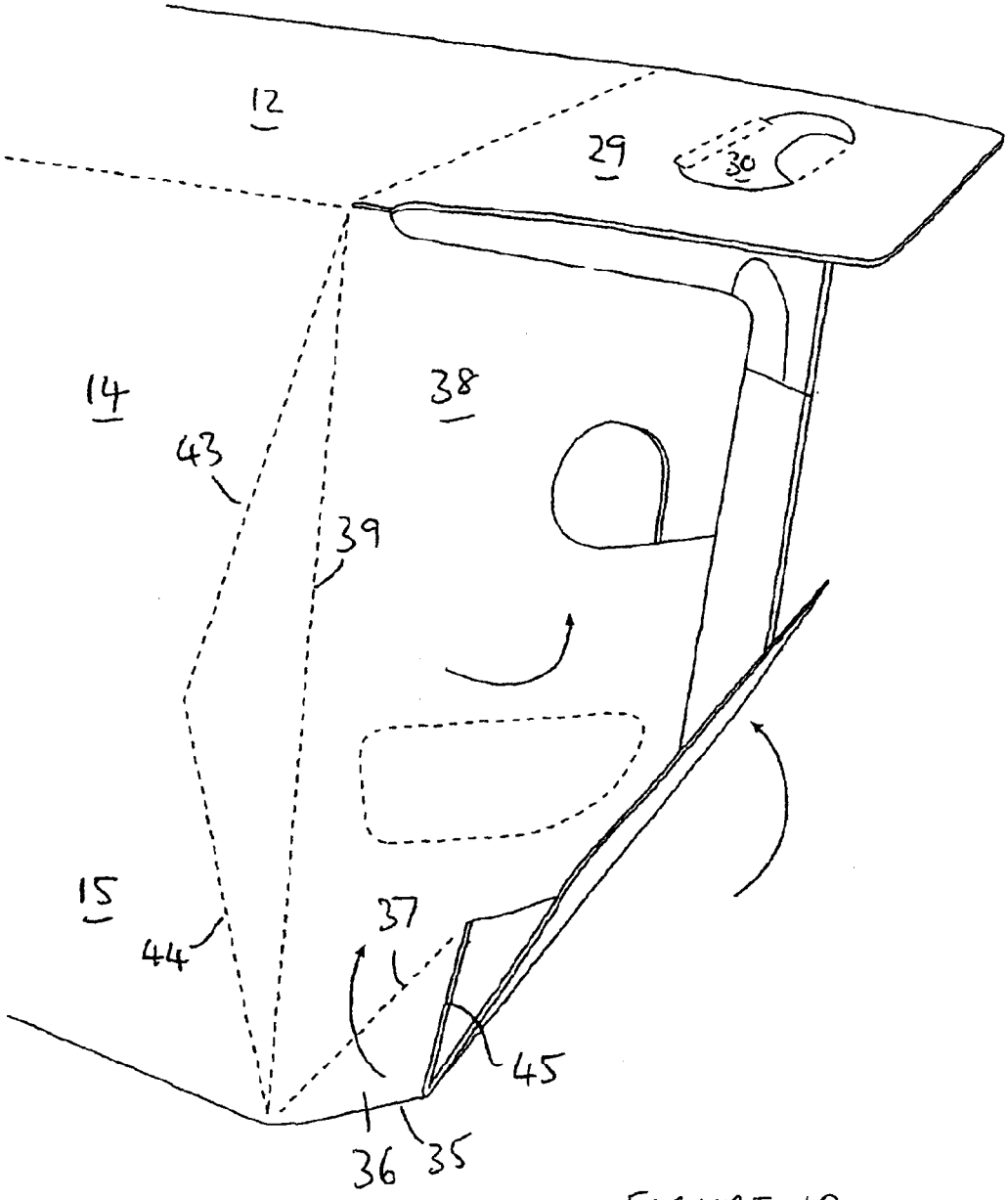
FIG. 10 is similar to FIG. 9 but somewhat later in the folding process.

The folding of the end panels at each end of the carton 10 is illustrated in FIGS. 9 and 10. As the side end panels 38 are folded inwardly across the open end of the sleeve, the base end panel 27 is folded upwardly about the fold 26. This causes the gusset panels 36 to activate about the fold 35 and the reverse 45° fold 37. The base end panel 27 is then glued to the side end panels 38. The top 12 can then be folded down and glued to the side end panels, generally not in the region of or blocking the push through flaps 30, 40.

Once folded, the free edges 45 of the gusset panels 36 are elevated from the base 18 of the carton. This forms a tray-like base area such that after the lines of weakening 24 are opened, ice or other substance can be deposited in the carton 10 around the bottles. The paperboard can be treated with a water resistant coating such as "Aquakote" (trade mark). As the ice melts, some cold water is retained in the carton, up to the level of the free edges 45 of the gusset panels 36 thus resisting leakage for a period of time. In this way the pack can be used to chill or keep chilled the contents of the carton and can still be moved due to the wet strength of the treated paperboard. This is in contrast to corrugated board which has a much lower wet strength.

The tray aspect of the base is also advantageous when a number of cartons are on pallets ready for distribution. With corrugated cartons, a broken bottle can, through leakage, adversely affect a whole pallet, which can lead to return of the whole pallet. With the present carton, a breakage can be contained as fluid is retained in the tray-like base area for a period of time without leakage.

Also during palletizing of cartons, since a likelihood of damage exists, the present carton includes a 4-ply cushion at the lower corner of the end panels. This can reduce the likelihood of damage to the more vulnerable corner bottles and provide improved carton integrity, while maintaining carton appearance.

Once the present carton 11 is assembled it has perpendicular end walls and sides that have a tapered upper portion. The top is, therefore, narrower between the sides than the base and this is beneficial for carrying bottles as the tapered sides results in a tighter package around the tops of the bottles. The ends, however, remain perpendicular to the base giving a perception of strength. The presence of the handles in the vertical ends is, however, beneficial.

Figure 5:
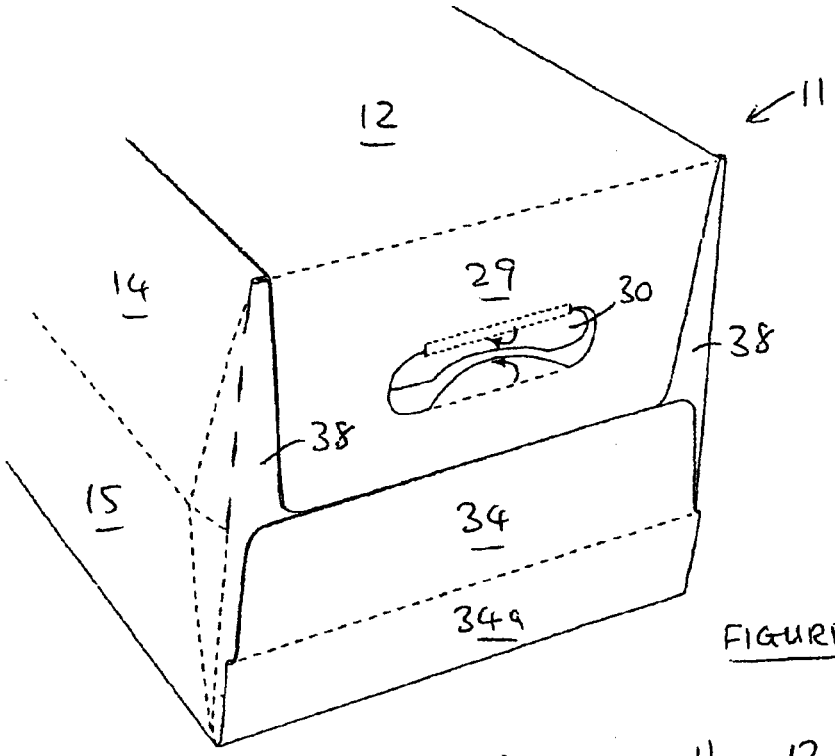
FIGS. 5 and 6 are an end perspective view showing the carton in various states of use.
Figure 6:
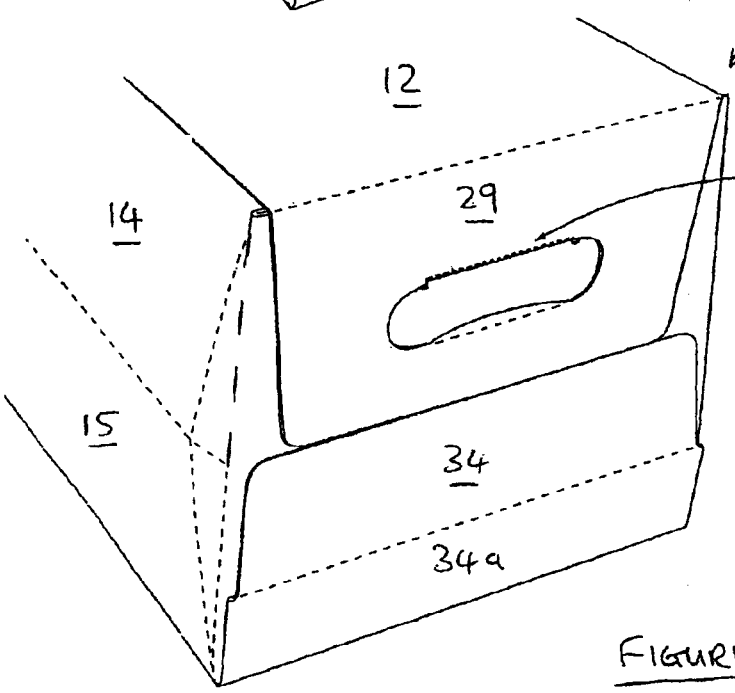
Figure 7:
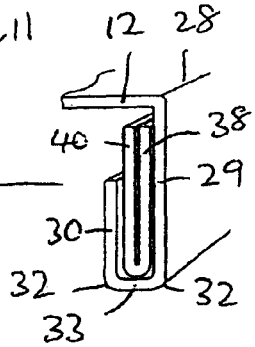
FIG. 7 is a close up perspective cross-section of a detail of FIG. 6.
Figure 8:
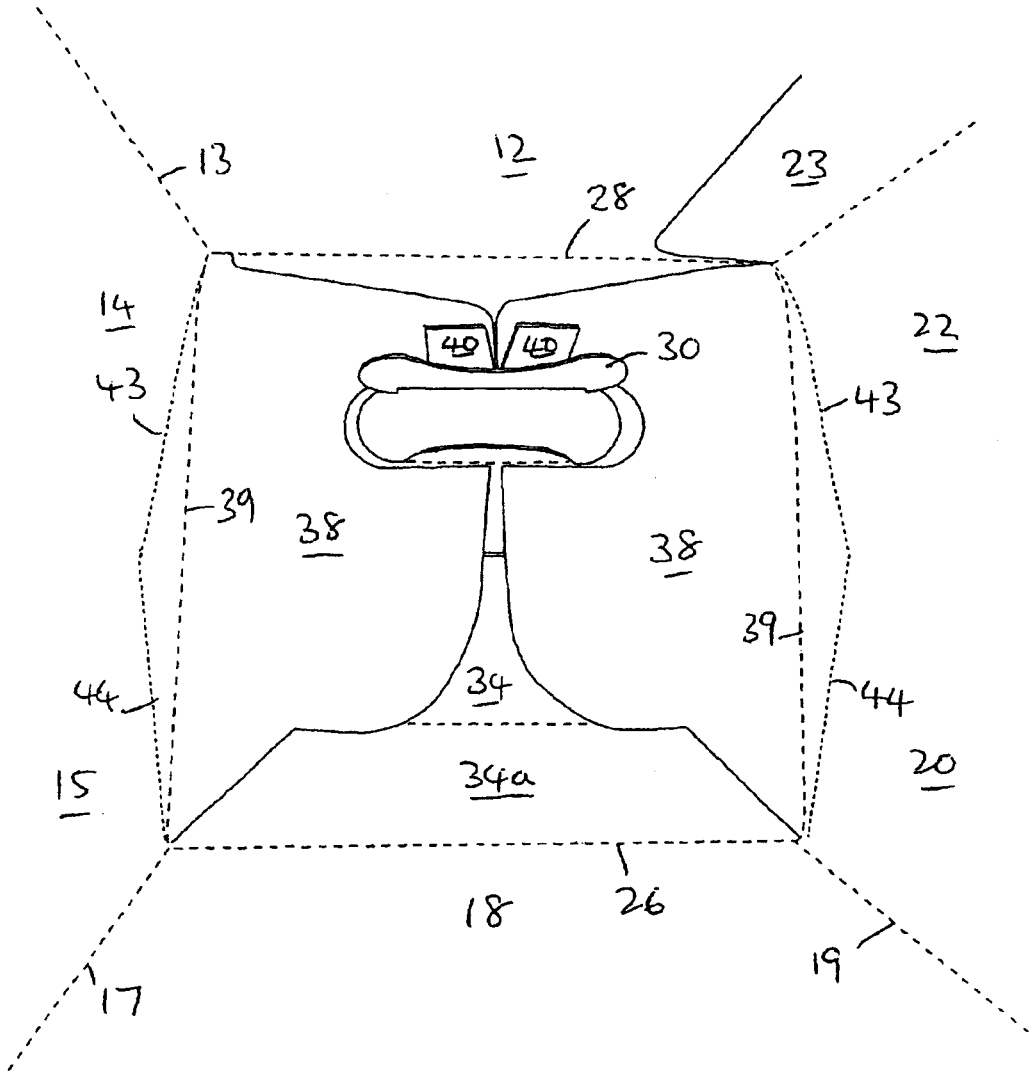
FIG. 8 is an internal view of the carton shown in FIG. 6.

When the carton 10 is to be lifted, the user pushes the push through flaps 30, 40 inside and upwardly behind the top end panel as illustrated in FIGS. 5 to 7. The vertical nature of the end wall provides sufficient space between the bottle necks and the end wall to accommodate the movement of the flaps 30, 40. FIG. 7 also shows how the narrow support panel 33 can take up a generally horizontal position accommodating the two plies of the side end panel 38 and its secondary push through flap 40. The support panel 33 is effective to distribute the weight of the carton better than a simple folded edge.

Returning to the perpendicular nature of the end panels, when the carton 11 is lifted by the handles in the end walls, the paperboard only has to contend with shear forces. If the end walls were tapered, there would also be an opening moment, which would make the handle area more prone to ripping.

The angled creases 43 and 44 act to facilitate the tapering of the upper side portions 14 when the pack is formed. The creases also give the corners of the carton a softer edge by providing a form of corner panel. This renders the carton less prone to corner damage.

Figure 11:
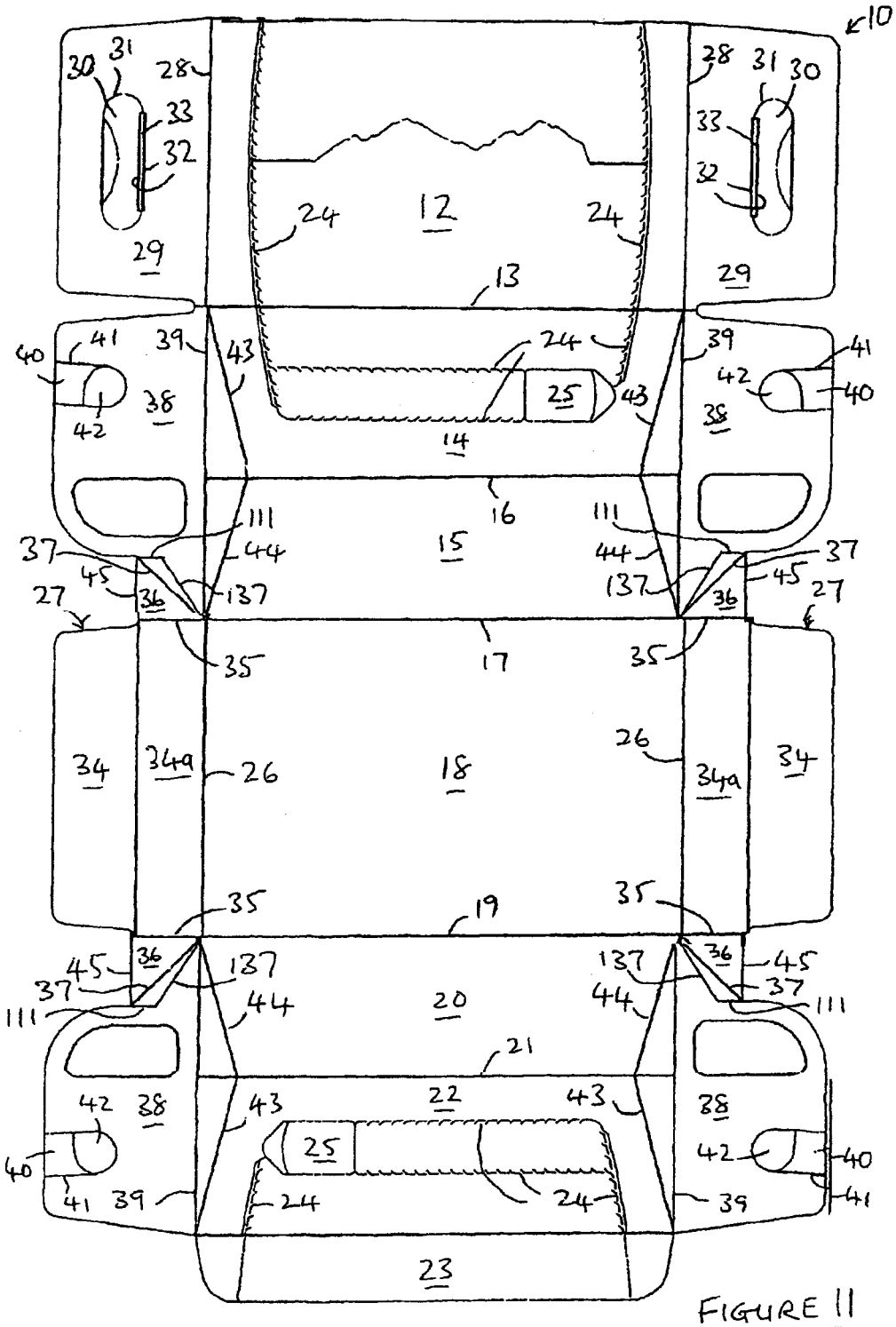
FIG. 11 shows a blank, similar to that shown in FIG. 1, of an alternate embodiment.
Figure 12:
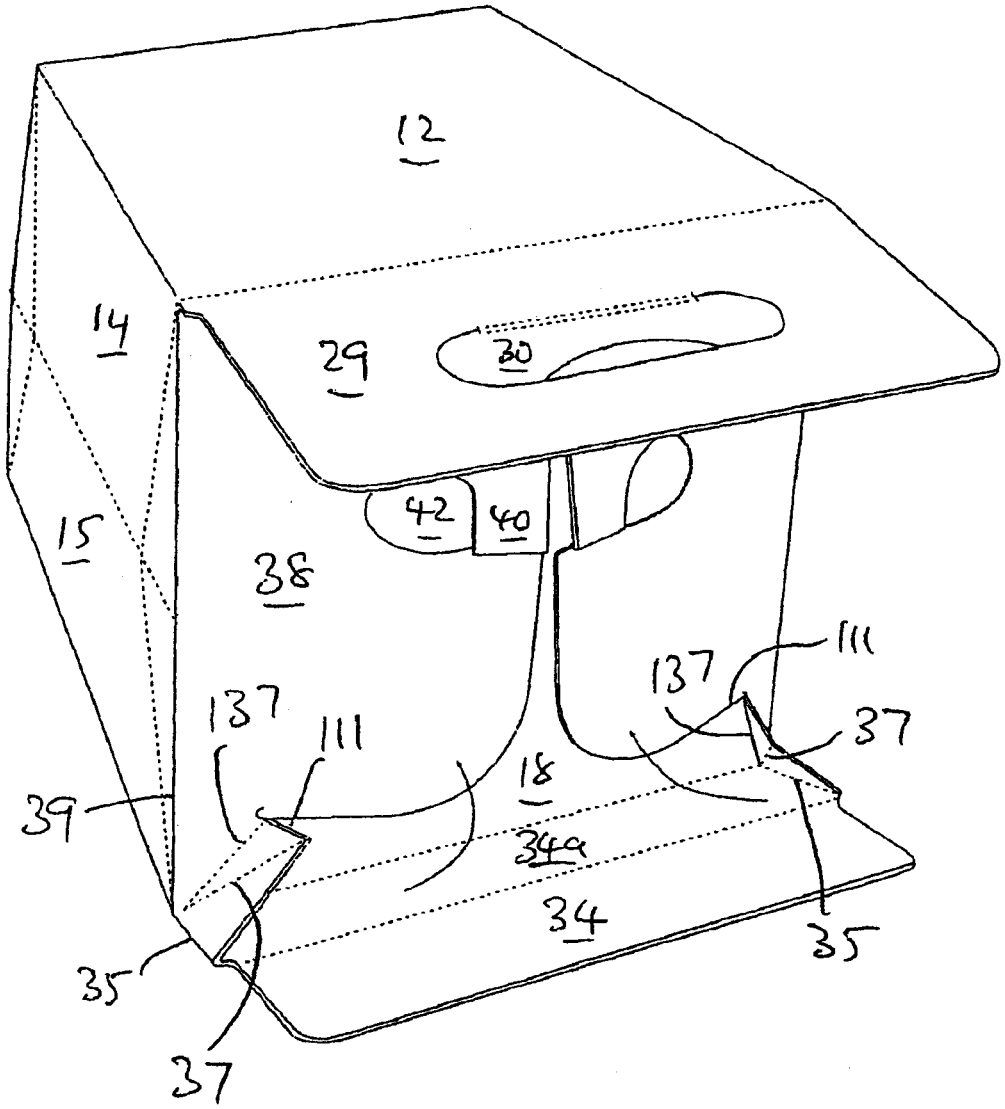
FIG. 12 is an end perspective view of the end panels of the FIG. 11 blank being folded.

Since the blank 110 of FIG. 11 is substantially identical to that shown in FIG. 1, like reference numbers correspond to like parts. In the blank 110, however, an additional reverse fold 137 in each gusset portion 36, between the 45° reverse fold 37 and the upright fold 39. A short cut 111 is provided from the end of the free edge 45 to the upper end of the additional reverse fold 137. The precise angle of the additional reverse fold 137 depends on a number of parameters, such as size of the end panels, thickness and stiffness of the paperboard etc.

It has been found that the additional reverse fold 137 and the cut 111 at each gusset area allows the side end panels 38 to be partially folded in before the base end panel 27 starts to fold up. This helps the side end flaps fold in squarely with minimum stress before pulling up the base end panel 27.

It will be appreciated that some of the features are still a matter of design choice such that variations of the above-described arrangements will still be covered by the following claims.

What is claimed is:

1. A fully enclosed paperboard carton comprising:

a top, a base, a first side panel, a second side panel, a first side end panel, and a second side end panel; a first base end panel and a second base end panel each including an upper base end panel portion and a lower base end panel portion; the first side end panel and the second side end panel being disposed at a first end of the carton and being substantially planar and perpendicular to the base and the top; a first top end panel having a handle flap; the handle flap being rotatable inwardly through 180°; the first side end panel including a first handle hole adjacent a first side panel push through flap; the first side panel including a lower side panel portion that is substantially planar and perpendicular to the base and an upper side panel portion that is substantially planar and tapers inwardly towards an edge connection with the top; a first gusset panel hingedly connected to the first side end panel and to the lower base end panel portion of the first base end panel;

wherein the first side panel push through flap is rotatable inwardly through 180° to be disposed behind the handle flap into a carrying position.

2. The carton of claim 1 further including a second top end panel, and wherein the first top end panel and the second top end panel are hingedly connected, and adhesively secured, to the top.

3. The carton of claim 1 wherein the first gusset panel is foldably connected to the first base end panel along a first lateral fold and the base is foldably connected to the first base end panel along a first longitudinal fold and the first gusset panel is foldably connected to the first side end panel at a first oblique fold that is 45° relative to the first lateral fold and wherein the second gusset panel is foldably connected to the second base end panel along a second lateral fold and the base, is foldably connected to the second base end panel along a second longitudinal fold, and the second gusset panel is foldably connected to the second side end panel at a second oblique fold that is 45° relative to the second lateral fold.

4. The carton of claim 1 wherein the first gusset panel is foldably connected to the first base end panel along a first lateral fold, the base is foldably connected to the first base end panel along a first longitudinal fold, and the first gusset panel is foldably connected to the first side end panel along a first oblique fold, the first gusset panel comprising a second oblique fold between the first oblique fold and the first lateral fold, a cut extends between the end of the first and second oblique fold adjacent an edge of the first side end panel.

5. The carton of claim 1 wherein the first top end panel handle flap defines a top end panel handle hole.

6. The carton of claim 1 wherein the first side panel push through flap is hingedly connected to the first top end panel along a substantially straight primary fold line.

7. The carton of claim 6 wherein the first side panel primary fold line comprises a pair of folds, spaced vertically apart a small distance to define a support panel therebetween.

8. The carton of claim 7 wherein the first side panel push through flap remains hingedly connected to the first side end panel along substantially straight secondary fold lines adjacent the primary fold line.

9. The carton of claim 1 wherein at each end of the first side panel and the second side panel, a corner formation defines a pair of creases, one crease of the pair extending from an apex at a junction between the top, and respective first and second side panels to a horizontal crease joining respective upper and lower side panel portions of the first and second side panels, and the other crease of the pair extending from an apex at a junction between the base, and respective first and second side panels to the horizontal crease joining respective upper and lower side panel portions of the first and second side panels.

10. The carton of claim 1 wherein lines of weakening are provided to facilitate access to the carton.

11. The carton of claim 1 wherein the second side end panel has a second handle hole adjacent a second side panel push through flap.

12. The carton of claim 1 wherein a second gusset panel is hingedly connected to the second side end panel and to the lower base end panel portion of the second base end panel.

13. A carton comprising:

a top, a base, a first side panel and a second side panel respectively connected to the top and the base, each of the first side panel and the second side panel having a lower portion and an upper portion, wherein the lower portion is generally perpendicular to the base, and the upper portion angles towards an interior of the carton, a first side end panel connected to the first side panel, a second side end panel connected to the second side panel; a first top end panel having a handle flap, the handle flap being rotatable inwardly through 180°, the first side end panel having a first handle hole adjacent a first side panel push through flap, the first side panel push through flap and the second push through flap being rotatable inwardly through 180°, a base end panel connected to a side of the base and overlapping the first side end panel to at least partially form a closed end of the carton, a gusset panel foldably connected to the base end panel and the first side end panel, the gusset panel being upwardly foldable relative to the base and including a free edge elevated from the base, wherein the base, the gusset panel, a portion of the first side panel, a portion of the second side panel, a portion of the first side end panel and a portion of the second side end panel form a tray, the tray being free from fluid permeable openings and having a top edge corresponding to the free edge of the gusset, and wherein the first side panel push through flap is rotatable inward to be disposed behind the handle flap into a carrying position.

14. The carton of claim 13 wherein the base end panel is foldably connected to the base along a longitudinal fold line, and the gusset panel is foldably connected to the base end panel along a lateral fold line perpendicular to the longitudinal fold line.

15. The carton of claim 14 wherein the gusset panel is foldably attached to the one of the first and second side end panels along an oblique fold line, wherein the longitudinal fold line, the lateral fold line and the oblique fold line intersect at a junction between the base and one of the first and second side panels.

16. The carton of claim 15 wherein the oblique fold line is at an angle of approximately 45 degrees with respect to the longitudinal fold line connecting the base end panel to the base.

17. The carton of claim 16 wherein the lateral fold line extends across an entire width of the gusset from an intersection with the longitudinal fold line to the free edge of the gusset.

18. The carton of claim 15 wherein the gusset panel comprises a two-piece web having a first portion foldably attached to the base end panel at a longitudinal fold line and a second portion foldably attached to the side end panel along an oblique fold line.

19. The carton of claim 18 wherein the first portion and the second portion are foldably attached along an oblique fold line, the oblique fold line being at an angle of approximately 45 degrees with respect to the longitudinal fold line connecting the base end panel to the base.

20. The carton of claim 13 further comprising:

a top end panel foldably connected to the top; and a handle panel foldably connected to the top end panel and defining a handle opening in the carton.

21. The carton of claim 13 wherein the base end panel has a first portion hingedly attached to the side of the base, and a second portion hingedly attached to the first portion, the first portion being attached to the base at a longitudinal fold line and being attached to the gusset panel at a lateral fold line.

22. The carton of claim 13 wherein the second side end panel has a second handle hole adjacent a second side panel push through flap.

23. The carton of claim 13 wherein a second gusset panel is hingedly connected to the second side end panel and to the lower base end panel portion of the second base end panel.

* * * * *